US007194962B2

(12) United States Patent
Edmondson

(10) Patent No.: US 7,194,962 B2
(45) Date of Patent: Mar. 27, 2007

(54) VERSATILE RAPID THERMAL PROCESS OVEN

(76) Inventor: Jerry M. Edmondson, 2 Escapade Ct., Newport Beach, CA (US) 92663

( * ) Notice: Subject to any disclaimer, the term of this patent is extended or adjusted under 35 U.S.C. 154(b) by 119 days.

(21) Appl. No.: 11/147,764

(22) Filed: Jun. 9, 2005

(65) Prior Publication Data

US 2006/0278141 A1 Dec. 14, 2006

(51) Int. Cl.
*C10B 1/06* (2006.01)
*C10B 31/00* (2006.01)
*C10B 7/00* (2006.01)

(52) U.S. Cl. ..... 110/230; 202/117; 202/137

(58) Field of Classification Search ..... 110/229, 110/230, 231; 202/137, 117; 201/29, 39
See application file for complete search history.

(56) References Cited

U.S. PATENT DOCUMENTS 4,122,036 A * 10/1978 Lewis ..... 502/421
5,279,234 A * 1/1994 Bender et al. ..... 110/210
5,411,714 A * 5/1995 Wu et al. ..... 422/232
5,653,183 A * 8/1997 Hansen et al. ..... 110/346

* cited by examiner

*Primary Examiner*—Kenneth Rinehart

(57) ABSTRACT

A versatile oven for converting carbon based natural resources and waste material to hydrocarbon vapor and carbon char utilizing rapid thermal processing and having the capability of utilizing a portion of the relatively inexpensive carbon based material being processed as the fuel to provide at least some of the process heat and also including a means for reducing NOx emissions in the gases exhausted from a furnace used to burn the converted hydrocarbon vapor for application of the heat energy and also a means for delivering the converted hydrocarbon vapor to a condensing system if it is desired to liquefy at least some portion of the thermally converted hydrocarbon vapor.

1 Claim, 1 Drawing Sheet

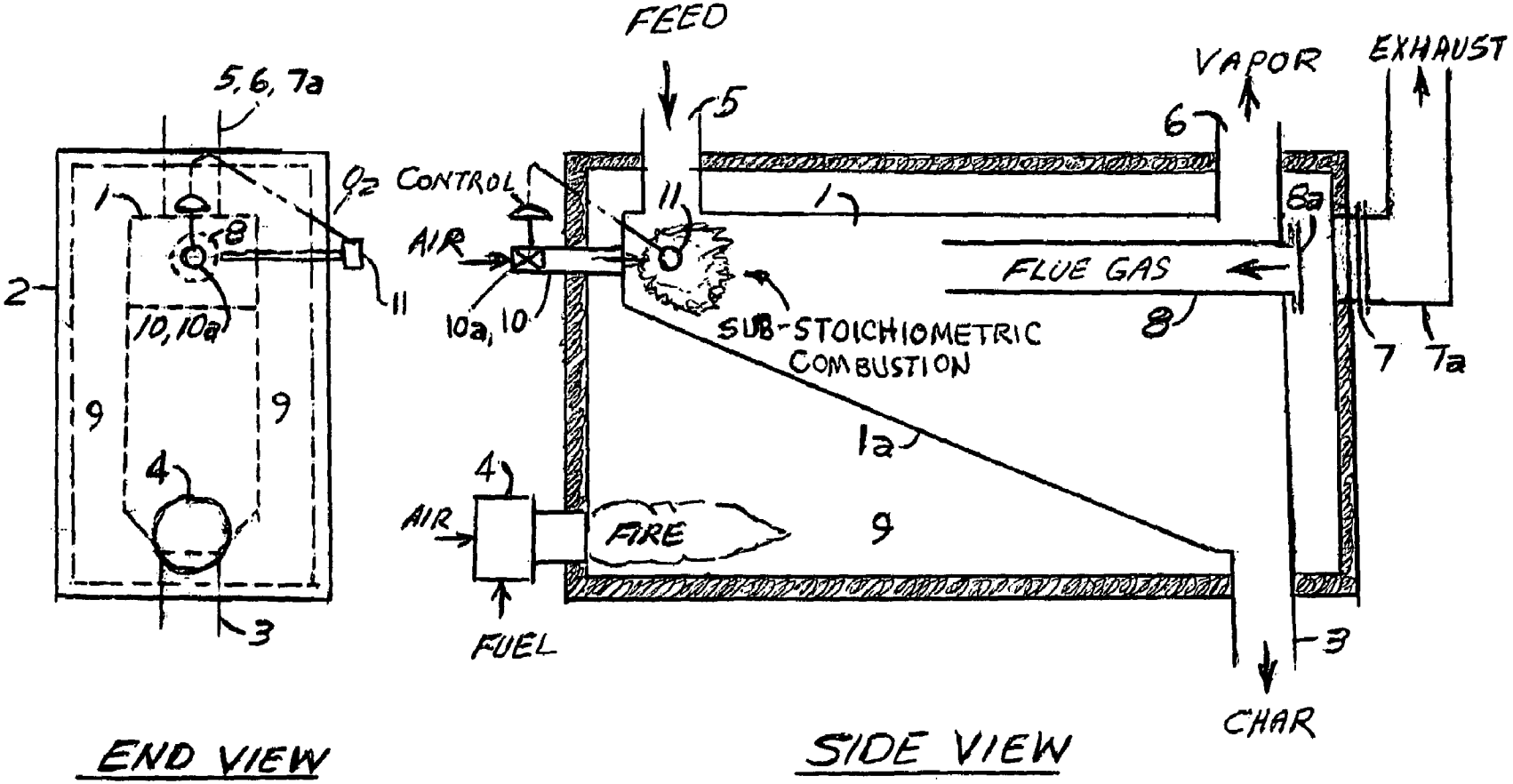
EXHAUST
7a
7
VAPOR
8a
3
CHAR
6
FLUE GAS
8
SUB-STOICHIOMETRIC COMBUSTION
1a
9
SIDE VIEW
FEED
5
11
FIRE
CONTROL
AIR
10a, 10
4
FUEL
AIR
$O_2$
11
5, 6, 7a
9
8
10, 10a
4
3
1
9
2
END VIEW

VERSATILE RAPID THERMAL PROCESS OVEN

BACKGROUND OF THE INVENTION

1. Field of the Invention

The present invention relates to resource recovery where heat is utilized in the process.

2. Discussion of Prior Art

Walker U.S. Pat. No. 6,619,214 describes a type of device often used to apply heat as part of a resource recovery system and places a lot of emphasis on the necessity of preventing air/oxygen from entering the oven interior and also illustrates the common means, external burners, for applying heat to the process.

The cost of purchasing commercial fuel to provide the process heat is a major operating expense and can be a serious drain on profits.

The products of combustion exhausted from the burners providing the process heat from the common type unit as illustrated by the Walker patent often contain unacceptable levels of NOx.

3. Discussion of the Present Invention

My invention discloses a type of oven that is very versatile with the capability of processing many different types of material including natural resources such as heavy crude oil, oil sand, oil shale, and waste material such as scrap tires, scrap wood and municipal waste and, to reduce operating cost, can utilize a portion of the material being processed in a simple unique manner to provide at least part of the fuel for the process heat. Further the invention being disclosed teaches a means for reducing NOx emissions.

SUMMARY OF THE INVENTION

It is the object of the present invention to provide a versatile thermal process oven having the capability of processing, for recovery of valuable products, carbon based natural resources and waste material and doing so in a manner that will reduce the cost for fuel to heat the process and also can provide a means for reducing NOx emission in the exhaust of the products of combustion from the recovery process.

The oven herein disclosed is primarily configured to convert carbon based materials being fed into the unit to a combustible vapor and char with the vapor being delivered to a furnace wherein the vapor is burned to produce heat energy. There is however, also disclosed, a configuration that will permit the vapor to be delivered to a system which, through a condensing process, will liquefy at least a portion of said vapor.

With this invention a portion of the feed stock can be used as fuel to heat the process through controlled sub-stoichiometric combustion of said portion of the feed stock inside the oven. This material being consumed as fuel will be less expensive than commercial fuel. The product of combustion (flue gas) from both the feed stock and from an external process burner, using commercial fuel, mixing with the vapor being converted from the feed stock will reduce the level of NOx in the subsequent combustion of that vapor.

BRIEF DISCRIPTION OF THE DRAWING

The drawing, an end view and a cross sectioned side view, is a schematic of the preferred embodiment of the invention.

All of the elements of the invention, illustrating the unique features lending to the versatility being disclosed, are shown and will become evident upon a reading of the description of the invention while viewing the drawing.

DESCRIPTION OF THE INVENTION

Referring to the drawing, the rapid thermal process oven consists of a containment vessel 1 constructed from a material suited for operation at elevated temperatures such as stainless steel, suspended inside of a heated refractory insulated vessel 2. The vessel 1 is configured in a unique way so that the bottom 1*a* forms a chute within which char, thermally converted from carbon based material being fed into the inside of vessel 1 through the conduit 5 for rapid thermal processing, can slide to the char outlet 3. Initially the heat for the process is usually provided by a fired heating means 4 that will elevate the temperature inside of the containment vessel to a temperature between 800° F. and 2000° F. depending on the material that is fed into the oven for rapid thermal processing.

The combustible vapor that is converted by rapid thermal processing, from the material being fed into the unit, will exit the inside of vessel 1 through the vapor conduit 6. In most applications the vapor will be delivered through a transfer system (not shown) to a furnace (not shown) to be burned for direct conversion to heat energy. That being the case the flue gas created by the fired heating means 4 will be directed through a conduit 8 that connects an annular space 9, between the inside refractory lined wall of the outside vessel 2 and the outside wall of the inside vessel 1, said annular space is where the flue gas resides after the fuel to said heating means 4 has been combusted. The purpose for directing the flue gas into the interior of the inside vessel is so that it will mix with the converted vapor to suppress NOx formation when the converted vapor is burned by the said furnace.

When the converted vapor is being used directly as fuel for a downstream furnace as described, then it can be economical to ignite a controlled sub-stoichiometric combustion of a portion of the carbon based material that is being fed into the unit for rapid thermal conversion, inside of the vessel 1. The controlled combustion of part of the material being processed will provide at least some of the process heat requirement and reduce the amount of expensive commercial fuel being used by the heating means 4.

The controlled combustion is accomplished by admitting some ambient air into the interior of the inside vessel 1 through a conduit 10 with the air flow being regulated by opening and closing a control valve 10*a* on command from an oxygen content sensor 11, thereby maintaining the combustion sub-stoichiometric to provide heat without danger of an explosion.

If it is desired to process at least a portion of the converted vapor into a liquid then the flue gas conduit 8 will be shut off by installing a cover 8*a* onto its inlet. An exhaust stack 7*a* will be installed on nozzle 7 so that the products of combustion (flue gas) from the fired heating means 4 will be exhausted through the nozzle 7, and only the vapor converted by the rapid thermal process will be delivered through the vapor conduit 6 so that it can be processed through a cooling and condensing system (not shown).

It is understood that certain features and sub-combinations are of utility and may be employed without reference to other features and sub-combinations. This is contemplated by and within the scope of the appended claims. It can be readily seen that the objectives and advantages are realized as disclosed by this specification and will be even better understood as described by the appended claims.

What is claimed is:

1. A versatile rapid thermal processing oven for converting carbon based natural resources and waste material to vapor and carbon char comprising;

an outer refractory insulated vessel having a fired heater extending into said outer vessel, an inner containment vessel suspended within said outer vessel for receiving therefrom heat transferred from said heater, said inner vessel having a first feed end and a second vapor end and having a bottom wall angled downwardly from the feed end to the vapor end forming an inclined chute there between, an inlet conduit extending through the outer vessel and in communication with said inner vessel adjacent the feed end for receiving carbon based material and discharging said material to an upper end of the inclined chute wherein said heat converts said material to vapor and carbon char, a carbon char discharge conduit at a lower end of said chute extending through the outer vessel, and a vapor outlet in communication with the inner vessel at the vapor end at a location above the carbon char discharge conduit for discharging the vapor, and further comprising at least one additional conduit extending from outside the outer vessel to inside the inner vessel for transporting ambient air into the interior of the inner vessel and including at least one control valve attached to said additional conduit outside the outer vessel and an oxygen sensor measuring the amount of oxygen inside the inner vessel.

* * * * *